US010464276B2

(12) United States Patent
Clément et al.

(10) Patent No.: US 10,464,276 B2
(45) Date of Patent: Nov. 5, 2019

(54) ROTARY-TOOL MANDREL, UNIT FOR CONVERTING A FLAT SUBSTRATE, AND OPERATING METHOD

(71) Applicant: BOBST MEX SA, Mex (CH)

(72) Inventors: Philippe Clément, Penthalaz (CH); Pierre Robadey, St Sulpice (CH)

(73) Assignee: BOBST MEX SA (CH)

( * ) Notice: Subject to any disclaimer, the term of this patent is extended or adjusted under 35 U.S.C. 154(b) by 255 days.

(21) Appl. No.: 15/531,801

(22) PCT Filed: Nov. 20, 2015

(86) PCT No.: PCT/EP2015/025086

§ 371 (c)(1),
(2) Date: May 31, 2017

(87) PCT Pub. No.: WO2016/087047

PCT Pub. Date: Jun. 9, 2016

(65) Prior Publication Data

US 2017/0305095 A1 Oct. 26, 2017

(30) Foreign Application Priority Data

Dec. 4, 2014 (EP) ..... 14020104

(51) Int. Cl.
*B31B 50/74* (2017.01)
*B41F 13/22* (2006.01)
(Continued)

(52) U.S. Cl.
CPC ..... *B31B 50/741* (2017.08); *B31B 50/146* (2017.08); *B31B 50/16* (2017.08);
(Continued)

(58) Field of Classification Search
CPC ..... B41F 27/105; B41F 27/1212; Y10T 29/49556; Y10T 29/49558
(Continued)

(56) References Cited

U.S. PATENT DOCUMENTS 4,111,569 A 9/1978 Mengel ..... 403/5
4,651,643 A 3/1987 Katz et al. ..... 101/375
(Continued)

FOREIGN PATENT DOCUMENTS

DE 100 39 744 A1 2/2002
EP 1 442 883 A1 8/2004
(Continued)

OTHER PUBLICATIONS

International Search Report dated Feb. 4, 2016 in corresponding PCT International Application No. PCT/EP2015/025086.
(Continued)

*Primary Examiner* — Jason L Vaughan
(74) *Attorney, Agent, or Firm* — Ostrolenk Faber LLP

(57) ABSTRACT

A rotary-tool mandrel for a unit for converting a flat substrate, on which a sleeve (13) is intended to be fitted, the mandrel includes a cylindrical core (14), a peripheral wall (17) that is able to take up a rest position and a locking position by exerting a radial pressure on the sleeve (13) in order to lock it in position on the mandrel (12), a pressure fluid circuit (21) provided between the peripheral wall (17) and the cylindrical core (14) for exerting the radial pressure on the sleeve (13), and a cooling fluid circuit (24) for allowing a fluid to flow in the region of the cylindrical core (14) and for cooling the mandrel (12).

15 Claims, 3 Drawing Sheets

(51) Int. Cl.

| | |
|---|---|
| ***B31B 50/88*** | (2017.01) |
| ***B31B 50/14*** | (2017.01) |
| ***B31B 50/16*** | (2017.01) |
| ***B31B 50/25*** | (2017.01) |
| ***B31B 100/00*** | (2017.01) |

(52) U.S. Cl.
CPC ..... *B31B 50/256* (2017.08); *B31B 50/88* (2017.08); *B41F 13/22* (2013.01); *B31B 2100/002* (2017.08)

(58) Field of Classification Search
USPC ..... 492/4, 46, 45; 165/89, 90; 101/375
See application file for complete search history.

(56) References Cited

U.S. PATENT DOCUMENTS 4,919,761 A * 4/1990 Schiel ..... D21F 3/0218 100/153
5,174,206 A * 12/1992 Molinatto ..... B41F 13/22 100/336
5,240,666 A * 8/1993 Schnyder ..... B21B 27/05 264/175
5,345,864 A * 9/1994 Machguth ..... B41F 13/10 101/216
5,481,975 A * 1/1996 Schulz ..... B41F 27/105 101/375
5,484,370 A * 1/1996 Jenke ..... B29C 43/24 492/16
5,595,115 A * 1/1997 Rau ..... B41F 7/37 101/142
5,788,382 A * 8/1998 Egbert ..... G03G 15/751 101/375
5,895,598 A * 4/1999 Kitano ..... B21B 27/055 100/92
6,261,487 B1 * 7/2001 Bongaerts ..... B29C 33/044 264/175
6,688,223 B1 * 2/2004 Dauner ..... B41F 13/22 101/217
2002/0022067 A1 * 2/2002 Helm ..... B29C 43/52 425/363
2003/0205156 A1 * 11/2003 Belanger ..... B41F 27/105 101/376
2004/0255804 A1 * 12/2004 Hoffmann ..... B41F 13/22 101/375
2012/0055359 A1 * 3/2012 Pertile ..... B41F 31/002 101/375
2014/0060354 A1 3/2014 Pantchev ..... 101/248

FOREIGN PATENT DOCUMENTS

WO WO 2005/105422 A1 11/2005
WO WO 2006/061869 A1 6/2006

OTHER PUBLICATIONS

Written Opinion dated Feb. 4, 2016 in corresponding PCT International Application No. PCT/EP2015/025086.

* cited by examiner

ROTARY-TOOL MANDREL, UNIT FOR CONVERTING A FLAT SUBSTRATE, AND OPERATING METHOD

CROSS-REFERENCE TO RELATED APPLICATION

The present application is a 35 U.S.C. §§ 371 national phase conversion of PCT/EP2015/025086, filed Nov. 20, 2015, which claims priority of European Patent Application No. 14020104.7, filed Dec. 4, 2014, the contents of all of which are incorporated herein by reference. The PCT International Application was published in the French language.

FIELD OF THE INVENTION

The present invention relates to a rotary-tool mandrel for a unit for converting a flat substrate. The invention relates to a conversion unit comprising at least one rotary-tool mandrel. The invention also relates to a method for operating a unit for converting a flat substrate.

BACKGROUND

A machine for converting a substrate is intended for the production of packaging. In this machine, an initial flat substrate, such as a continuous web of cardboard, is unrolled and printed on by a printing station comprising one or more printer units. The flat substrate is then transferred into an introduction unit and then into an embossing unit, possibly followed by a scoring unit. The flat substrate is then cut in a cutting unit. After ejection of the scrap areas, the preforms obtained are sectioned in order to obtain individual boxes.

The rotary conversion may be an embossing unit, a scoring unit, a cutting unit, a scrap-ejection unit, or a printer unit. Each rotary conversion unit comprises a cylindrical upper conversion tool and a cylindrical lower conversion tool, between which the flat substrate passes in order to be converted. In operation, the rotary conversion tools rotate at the same speed but in opposite directions to one another. The flat substrate passes through the gap situated between the rotary tools, which form a relief by embossing, form a relief by scoring, cut the flat substrate into preforms by rotary cutting, eject the scrap, or print a pattern during printing.

The cylinder changing operations have been found to be time-consuming and tedious. The operator must mechanically disconnect the cylinder in order to remove it from its drive mechanism. Then, the operator must extract the cylinder from the conversion machine and fit the new cylinder in the conversion machine by reconnecting it to its drive. The weight of a cylinder is high, around 50 kg to 2000 kg. In order to extract it, the operator must lift the cylinder with the aid of a hoist.

Because of its fairly high weight, a cylinder cannot be changed very quickly. Moreover, numerous tool changes may be necessary to obtain a very large number of boxes that are different from one another. These tools have to be ordered a long time in advance, which is becoming incompatible with the production changes that are currently required. In addition, tools are relatively expensive to produce and they only become cost-effective with an extremely large output.

Therefore, some conversion units have rotary tools made up of a mandrel and a removable sleeve carrying the form for carrying out the conversion that is able to be fitted on the mandrel. All that is necessary is to change the sleeve rather than the entire rotary tool. This makes it easier to change the tool because of the low weight of the sleeve and reduces costs since the sleeve is less expensive.

The passage of the flat substrate through the successive conversion units tends to heat the flat substrate, notably as it passes through the printer units. The heated flat substrate in turn heats the rotary tools since the latter, which are generally metallic, are very good conductors of heat. The dimensions of a sleeve are thus generally provided in order to limit the play between the sleeve and the mandrel during conversion operations. A resulting difficulty is that when the conversion unit is stopped, the sleeve, which has better thermal conductivity than the mandrel, cools down more quickly than the latter. It is then difficult to remove the sleeve from the mandrel.

SUMMARY OF THE INVENTION

An aim of the present invention is to propose a mandrel, a rotary tool, a unit for converting a flat substrate, and an operating method which at least partially solve the drawbacks of the prior art.

To this end, a subject of the present invention is a rotary-tool mandrel for a unit for converting a flat substrate, on which a sleeve is intended to be fitted. The rotary-tool mandrel comprises:

- a cylindrical core,
- a peripheral wall that is able to take up a rest position and which is able to take up a locking position by exerting a radial pressure on the sleeve in order to lock the sleeve in position on the rotary-tool mandrel, and
- a pressure fluid circuit, which is provided between the peripheral wall and the cylindrical core, for exerting the radial pressure on the sleeve.

According to a first aspect of the invention, the rotary-tool mandrel is characterized in that it comprises a cooling fluid circuit for allowing a fluid to flow in the region of the cylindrical core and for cooling the rotary-tool mandrel.

A further subject of the present invention is a rotary-tool mandrel for a unit for converting a flat substrate, on which a sleeve is intended to be fitted. The rotary-tool mandrel comprises:

- a cylindrical core, and
- a cooling fluid circuit for allowing a fluid to flow in the region of the cylindrical core and for cooling the rotary-tool mandrel.

According to a second aspect of the invention, the rotary-tool mandrel is characterized in that it comprises:

- a peripheral wall that is able to take up a rest position and which is able to take up a locking position by exerting a radial pressure on the sleeve in order to lock the sleeve in position on the rotary-tool mandrel, and
- a pressure fluid circuit, which is provided between the peripheral wall and the cylindrical core, for exerting the radial pressure on the sleeve.

The pressure fluid circuit for the tool is used to secure the sleeve to the mandrel and thus to form the complete tool. The cooling fluid circuit is used for the flow and cooling of a fluid, in order to cool the mandrel. This cooling fluid circuit for the tool makes it possible to rapidly cool the mandrel and the sleeve when the conversion unit is stopped, making it easier to extract the sleeve. The cooling fluid circuit makes it possible to make the temperature of the mandrel and sleeve assembly uniform.

According to a particularly favorable exemplary embodiment, the pressure circuit and the cooling circuit are connected together, thereby forming one and the same circuit with a single fluid. According to one exemplary embodiment, a docking port for the cooling circuit is arranged at a front end of the mandrel and a docking port for the pressure circuit is arranged at a rear end of the mandrel. The docking ports are for example, aligned along an axis of rotation of the mandrel.

According to one exemplary embodiment, each docking port comprises a connection element of the mandrel, intended to engage with a complementary connection element of the conversion unit in order to connect the pressure fluid circuit to the cooling fluid circuit.

For example, the connection elements and the complementary connection elements are of the quick-connector type, taking up a closed-off position when they are disconnected, and an open position, allowing the passage of a fluid, when they are connected. This makes it possible to automatically close the pressure circuit when the complementary connection elements are disconnected.

According to one embodiment, the pressure circuit has a portion in the form of a tube, coaxial with the axis of rotation of the mandrel, around the cylindrical core. The pressure circuit has at least one axial duct portion provided in each journal of the mandrel, the axial duct portion linking a docking port. The pressure circuit comprises at least one duct portion linking each axial duct portion to the portion in the form of a tube. This embodiment of the pressure circuit is simple to realize and makes it possible to hold the sleeve uniformly over its entire interior envelope surface. This form of circuit also makes it possible to cause the fluid to flow from one end of the mandrel to the other.

A further subject of the invention is a unit for converting a flat substrate, such as a scoring unit, an embossing unit, a rotary cutting unit, a scrap ejection unit, or a printing unit, comprising at least one mandrel as described and claimed below. The cooling circuit is intended to be connected to a cooling module configured to cool the fluid. The cooling circuit is connected to the pressure circuit and forms, for example, a closed circuit.

A further subject of the invention is a method for operating a conversion unit, as described and claimed below. The method comprises the steps of:

- connecting only one of the two docking ports of the pressure circuit to the cooling circuit,
- sending a fluid through the pressure circuit in order that the peripheral wall exerts a radial pressure on the sleeve in order to lock the sleeve in position on the mandrel, and
- connecting the two docking ports of the pressure circuit to the cooling circuit and causing a cooled fluid to flow through the pressure circuit in order to cool the mandrel.

The flow of the fluid through the pressure circuit in order to cool the mandrel is realized, for example, in a closed circuit. The docking port of the pressure circuit connected to the cooling circuit in order to secure the sleeve to the mandrel is, for example, the docking port arranged at the rear of the mandrel, on the opposite side from the driver.

Thus, the act of securing the sleeve to the mandrel or the act of cooling the mandrel can be controlled and automated easily by the acts of connecting or disconnecting the pressure circuit to/from the cooling circuit.

BRIEF DESCRIPTION OF THE FIGURES

Further advantages and features will become apparent from reading the description of the invention and from the appended figures, which show a nonlimiting exemplary embodiment of the invention and in which.

Figure 2:
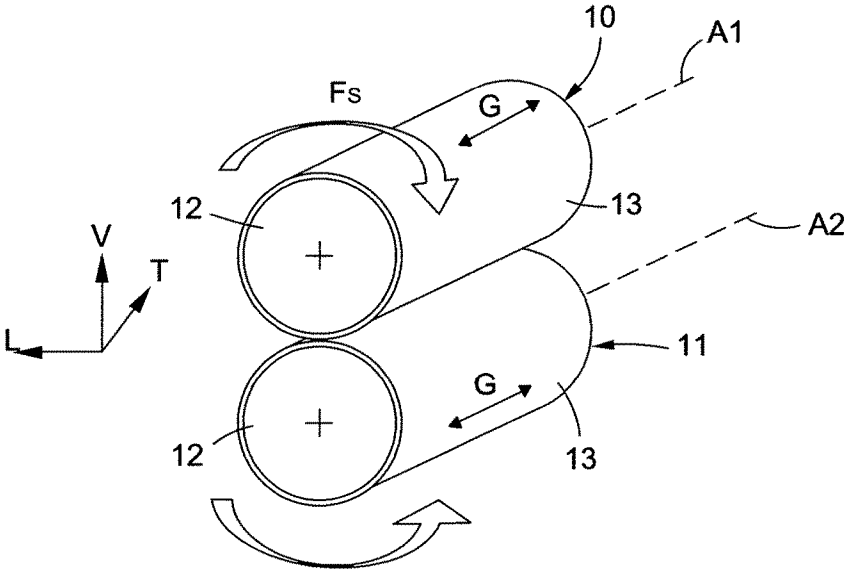
FIG. 2 shows a perspective view of an upper rotary tool and of a lower rotary tool.

The longitudinal, vertical and transverse directions indicated in FIG. 2 are defined by the trihedron L, V, T. The transverse direction T is the direction perpendicular to the longitudinal direction of movement L of the flat substrate. The horizontal plane corresponds to the plane L, T. The front and rear positions are defined with respect to the transverse direction T as being on the side of the driver and on the opposite side from the driver, respectively.

DETAILED DESCRIPTION OF PREFERRED EMBODIMENTS

Figure 1:
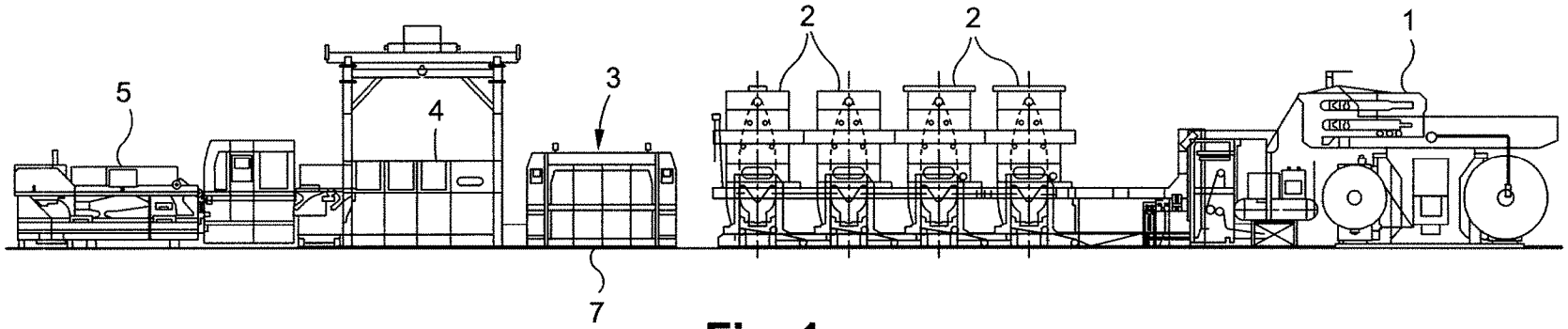
FIG. 1 is an overall view of an example of a conversion line for converting a flat substrate.

A conversion line for converting a flat substrate, such as flat cardboard or a continuous web of paper wound on a reel, makes it possible to carry out various operations and obtain packaging such as folding boxes. As shown in FIG. 1, the conversion line comprises, disposed one after another in the order of passage of the flat substrate, an unwinding station 1, several printer units 2, one or more embossing units in series followed by one or more scoring units in series 3, followed by a rotary cutting unit 4 or platen die-cutting unit, and a station 5 for receiving the manufactured objects.

The conversion unit 7 comprises an upper rotary tool 10 and a lower rotary tool 11, which modify the flat substrate by printing, embossing, scoring, cutting, ejection of scrap, etc., in order to obtain packaging.

The rotary tools 10 and 11 are mounted parallel to one another in the conversion unit 7, one above the other, and extend in the transverse direction T, which is also the direction of the axes of rotation A1 and A2 of the rotary tools 10 and 11 (see FIG. 2). The rear ends of the rotary tools 10 and 11, on the opposite side from the driver, are driven and rotated by motorized drive means. In operation, the rotary tools 10 and 11 rotate in opposite directions about each of the axes of rotation A1 and A2 (arrows Fs and Fi). The flat substrate passes through the gap situated between the rotary tools 10 and 11 in order to be embossed and/or scored and/or cut and/or printed on therein.

At least one of the two rotary tools, the upper rotary tool 10 or the lower rotary tool 11, comprises a mandrel 12 and a removable sleeve 13 that is able to be fitted on the mandrel 12 in the transverse direction T (FIG. 2, arrow G). Thus, when changing the rotary tools 10 and 11 is desired, all that is necessary is to change the sleeves 13 rather than the entire rotary tool 10 and 11. Since it is easier to handle the sleeve 13 on account of its low weight relative to that of the entire rotary tool 10 and 11, the change of operation can be effected rapidly. Moreover, the sleeves 13 are inexpensive compared with the price of the rotary tool 10 and 11 as a whole. It is thus advantageous to use one and the same mandrel 12 in combination with several sleeves 13 rather than to acquire several entire rotary tools 10 and 11. The sleeve 13 has a cylindrical overall shape. It is made, for example, of aluminum material.

Figure 3:
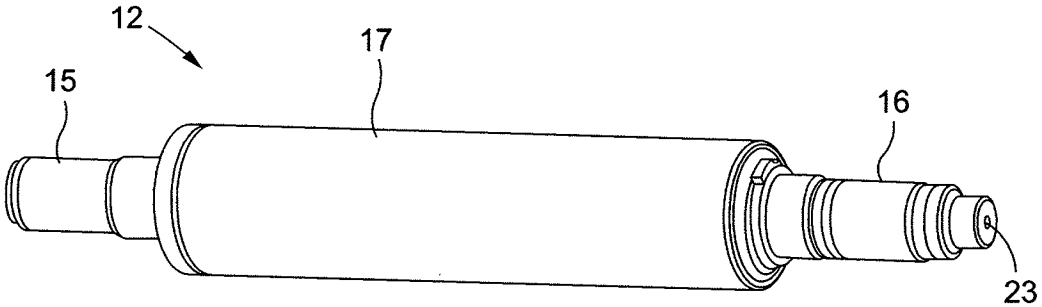
FIG. 3 shows a perspective view of a mandrel.

The mandrel 12 comprises a cylindrical core 14, a front journal 15, a rear journal 16 on either side of the cylindrical core 14, forming a rotating shaft of the rotary tool, and a peripheral wall 17 surrounding the cylindrical core 14 (FIG. 3). The front and rear journals 15 and 16 have a cylindrical overall shape. They are held by front and rear bearings 18, 19, respectively, of the conversion unit 7. In operation, the rear journals 16 of the rotary tools 10 and 11, on the opposite side from the driver, are driven and rotated by a motorized drive system 20. The elements of the mandrel 12, that is to say the cylindrical core 14, the front and rear journals 15 and 16, and the peripheral envelope 17, are made of a metal material, such as steel.

The cylindrical peripheral wall 17 can take up a rest position and a locking position in which the peripheral wall 17 exerts a radial pressure on the sleeve 13 in order to lock the latter in position on the mandrel 12, for example, by radial deformation of the peripheral wall 17.

The mandrel 12 also comprises a tool pressure fluid circuit 21 provided in part between the peripheral wall 17 and the cylindrical core 14 (FIGS. 4 and 5) in order to control the exertion of the radial pressure by the peripheral wall 17. The pressure circuit 21 is intended to receive a fluid in order to press the peripheral wall 17 against the interior envelope surface of the sleeve 13 in order to hold the sleeve 13 on the mandrel 12. The sleeve 13 thus held firmly on the mandrel 12 can be driven and rotated about the axis of rotation A1 and A2. The fluid is, for example, oil.

The pressure circuit 21 comprises a docking port 22 to a cooling fluid circuit 24 of the conversion unit 7 in order to allow a fluid to flow through the pressure circuit 21 in order to cool the mandrel 12. According to one exemplary embodiment, a docking port 22 is arranged at a front end of the mandrel 12. The pressure circuit 21 comprises another docking port 23 arranged at a rear end of the mandrel 12. The pressure circuit 21 can thus lead out of the mandrel 12 through an orifice of the docking port 22 provided in the front journal 15 and through an orifice of the docking port 23 provided in the rear journal 16. The docking ports 22 and 23 are aligned, for example, along the axis of rotation A1 or A2 of the mandrel 12, and arranged at the respective ends of the front and rear journals 15 and 16. According to one embodiment, the pressure circuit 21 has axial symmetry.

Figure 5:
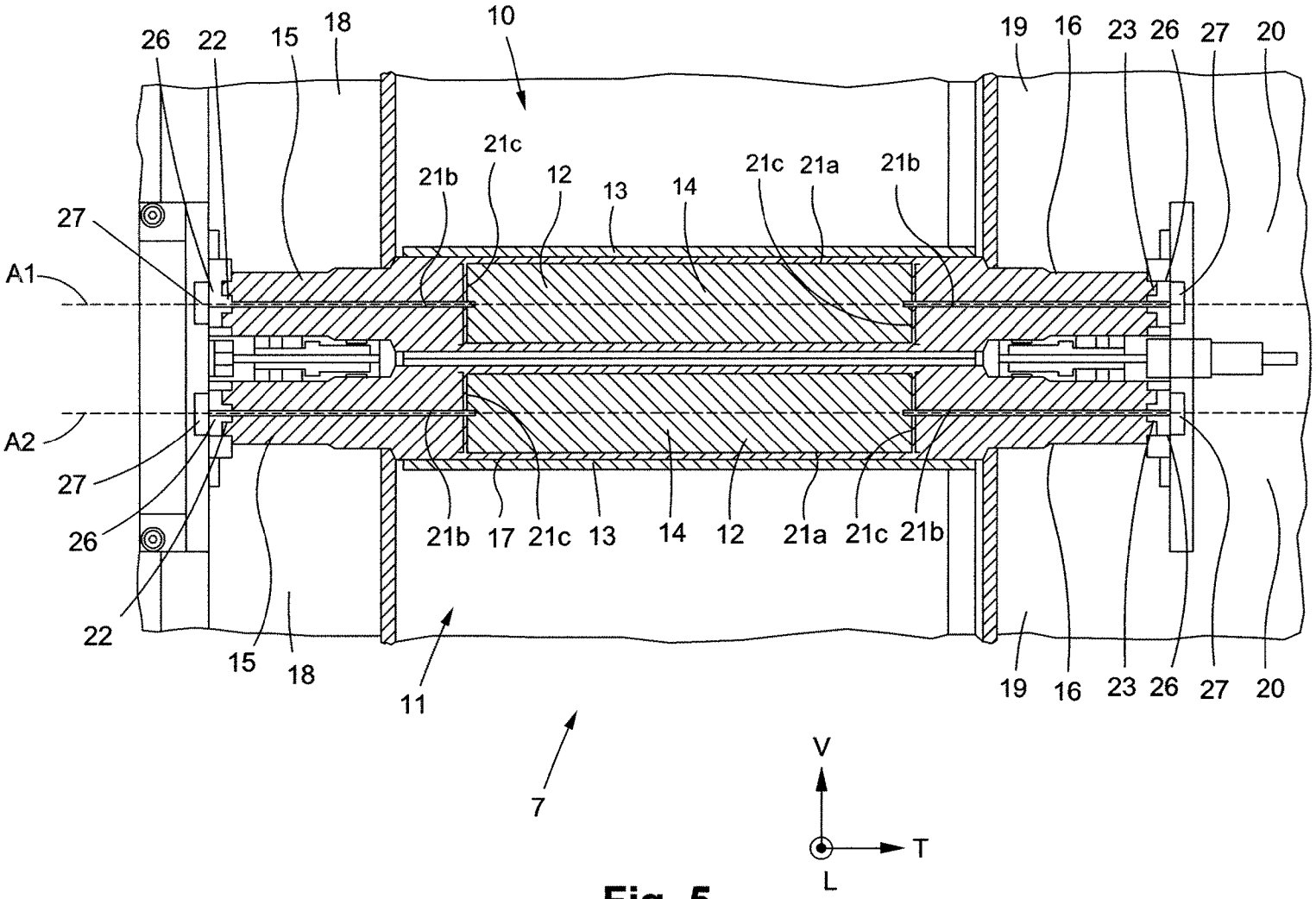
FIG. 5 shows a partial view in vertical section of a conversion unit in which two rotary tools are mounted that each comprise a mandrel and a sleeve secured to the mandrel.

For example, the pressure circuit 21 has a portion in the form of a tube 21*a*, two axial duct portions 21*b* and two radial duct portions 21*c* (FIG. 5). The axial and radial duct portions 21*b*, 21*c* are linear. The portion in the form of a tube 21*a* is coaxial with the axis of rotation A1 or A2 of the mandrel 12 and formed around the cylindrical core 14. The peripheral wall 17 is, for example, shrunk onto and then welded to the cylindrical core 14, leaving a gap of a few millimeters forming the portion in the form of a tube 21*a* of the pressure circuit 21.

The axial duct portions 21*b* are aligned along the axis of rotation A1 and A2 of the mandrel 12 and are formed in a respective journal 15 and 16. Each axial duct portion 21*b* links a docking port 22 and 23 to a radial duct portion 21*c*, forming a right angle. Each radial duct portion 21*c* extends radially in order to link an axial duct portion 21*b* at two diametrically opposite points of one end of the portion in the form of a tube 21*a*. This embodiment of the pressure circuit 21 is simple to realize and makes it possible to hold the sleeve 13 uniformly over its entire interior envelope surface.

Figure 4:
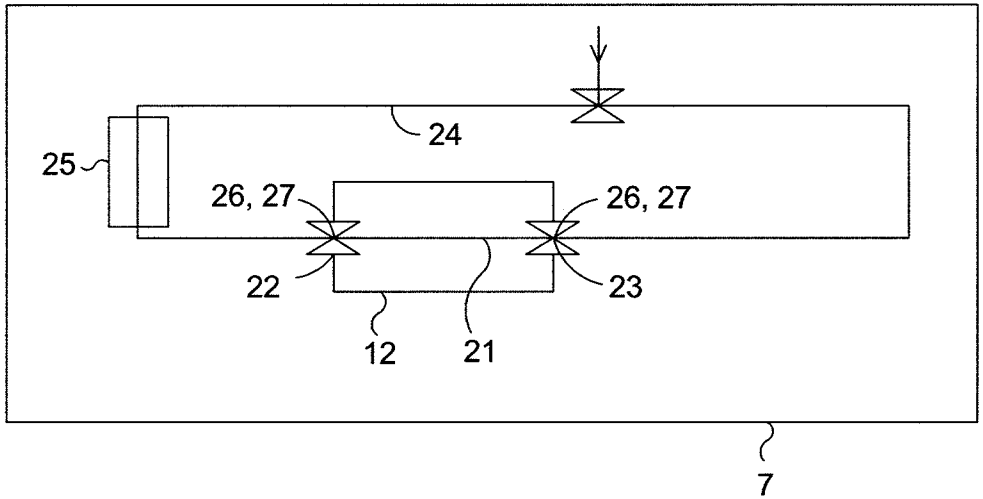
FIG. 4 shows a view of a pressure circuit connected to a cooling circuit, forming a closed circuit.

The pressure circuit 21 is intended to be connected to the cooling circuit 24, for example, forming a closed circuit (see FIG. 4). The conversion unit 7 also comprises a cooling module 25 configured to cool the fluid flowing through the cooling circuit 24. The cooling module 25 comprises for example a pump for causing the fluid to flow through the cooling circuit 24, and a heat exchanger that is able to cool the fluid flowing through the cooling circuit 24.

According to one exemplary embodiment, each docking port 22, 23 comprises a connection element 26 of the mandrel 12, intended to engage with a complementary connection element 27 of the conversion unit 7 in order to connect the pressure circuit 21 to the cooling circuit 24.

The connection elements 26 are, for example, separate elements that are mounted tightly in an orifice of the respective docking port 22 and 23 of the pressure circuit 21. The connection elements 26 and the complementary connection elements 27 are, for example, of the quick-connector type. The ends of the connection elements 26 and 27 engaging with one another are, for example, of the male/female type.

The quick connectors are also configured to take up a closed-off position when they are disconnected from one another and an open position allowing the passage of the fluid when they are connected together. This makes it possible to automatically close the pressure circuit 21 when they are disconnected, which is necessary in order for the radial pressure to be exerted by the peripheral wall 17 in order to secure the sleeve 13 to the mandrel 12.

In an example of a method for operating the conversion unit 7, in order to lock the sleeve 13 in position on the mandrel 12, only one of the two docking ports 22 and 23 of the pressure circuit 21, such as the docking port 23 arranged at the rear of the mandrel 12, is connected. The connection element 26 of the docking port 22 arranged at the front of the mandrel 12 is then in the closed-off position, closing the pressure circuit 21 (FIG. 5).

Next, a fluid is sent through the pressure circuit 21. The cooling circuit 24 is isolated from the cooling module 25. The pressure exerted by the fluid in the pressure circuit 21 then pushes the peripheral wall 17 radially, into the locking position, pressing the peripheral wall 17 against the interior envelope surface of the sleeve 13, thereby fixing the sleeve 13 firmly to the mandrel 12.

At least one of the two connection elements 26 of the mandrel 12 remains connected to the complementary connection element 27 of the conversion unit 7. The sleeve 13 thus held firmly on the mandrel 12 can be driven in rotation by the mandrel 12 in order to carry out operations of converting the flat substrate.

At the end of the operations, once the conversion unit 7 has been stopped, that is to say when the rotary tools are no longer rotating, the pressure of the fluid is reduced in order to disconnect the sleeve 13 from the mandrel 12.

Next, the other of the two docking ports 22 of the pressure circuit 21 is connected to the cooling circuit 24. The connection elements 26 thus connected to the complementary connection elements 27 allow the fluid to flow through the cooling circuit 24, forming a closed circuit, in order to be cooled by the cooling module 25 and to cool the mandrel 12. The mandrel 12 and the sleeve 13 can then be cooled. When the mandrel 12 has been sufficiently cooled and the peripheral wall 17 is in its rest position, the sleeve 13 can be removed easily.

The pressure circuit 21 used to secure the sleeve 13 to the mandrel 12 is thus also used for cooling the mandrel 12 when the conversion unit 7 is stopped. This second use of the pressure circuit 21 makes it possible to accelerate the cooling of the mandrel 12 in order to release the sleeve 13 more easily and rapidly. Moreover, the act of securing the sleeve 13 to the mandrel 12 or of cooling the mandrel 12 can be controlled and automated easily by the acts of connecting or disconnecting the pressure circuit 21.

The present invention is not limited to the embodiments described and illustrated. Numerous modifications can be made without otherwise departing from the scope defined by the set of claims.

The invention claimed is:

1. A rotary-tool mandrel for a conversion unit for converting a flat substrate, the mandrel being configured to receive a sleeve thereon, the mandrel comprising:

a cylindrical core;

a front journal and a rear journal respectively on either end of the cylindrical core;

a front bearing of the conversion unit holding the front journal;

a rear bearing of the conversion unit holding the rear journal;

the front journal and the rear journal forming a rotating shaft of the rotary-tool mandrel;

a peripheral wall that is able to take up a rest position and a locking position by exerting a radial pressure on the sleeve in order to lock the sleeve in position on the mandrel;

a pressure fluid circuit provided between the peripheral wall and the cylindrical core for exerting the radial pressure on the sleeve; and a cooling fluid circuit for allowing a fluid to flow in the region of the cylindrical core and for cooling the mandrel.

2. The mandrel according to claim 1, wherein the pressure circuit and the cooling circuit are connected together.

3. The mandrel according to claim 1, wherein a docking port for the cooling circuit is arranged at a front end of the mandrel, and a docking port for the pressure circuit is arranged at a rear end of the mandrel.

4. The mandrel according to claim 3, wherein the docking ports are aligned along an axis of rotation the mandrel.

5. The mandrel according to claim 3, wherein each docking port comprises a connection element of the mandrel configured to engage with a complementary connection element of the conversion unit in order to connect the pressure circuit to the cooling circuit.

6. The mandrel according to claim 5, wherein the connection elements and the complementary connection elements are of the quick-connector type, taking up a closed-off position when the connection elements and the complementary connection elements are disconnected, and taking up an open position, allowing the passage of a fluid, when the connection elements and the complementary connection elements are connected.

7. The mandrel according to claim 1, wherein the pressure circuit has a portion in the form of a tube around the cylindrical core and coaxial with the axis of rotation of the mandrel.

8. The mandrel according to claim 1, wherein the pressure circuit has a respective axial duct portion in at least one of the front journal and the rear journal, each respective axial duct portion linking to a respective docking port to allow a pressure fluid to flow through the pressure circuit from the respective docking port to each respective axial duct portion.

9. The mandrel according to claim 8, wherein the pressure circuit comprises at least one radial duct portion in the cylindrical core, the at least one radial duct portion linking each respective axial duct portion to a portion in the form of a tube around the cylindrical core and coaxial with the axis of rotation of the mandrel, to allow a pressure fluid to flow through the pressure circuit from each respective axial duct portion to the portion in the form of a tube around the cylindrical core.

10. A unit for converting a flat substrate, comprising at least one mandrel according to claim 1.

11. The unit according to claim 10, wherein the cooling circuit is connected to a cooling module for cooling the fluid.

12. The unit according to claim 10, wherein the pressure circuit connected to the cooling circuit forms a closed circuit.

13. A method for operating a conversion unit for converting a flat substrate, the conversion unit comprising:

at least one rotary-tool mandrel for a unit for converting a flat substrate, the mandrel being configured to receive a sleeve thereon;

the mandrel comprising:

a cylindrical core;

a peripheral wall configured to take up a rest position and a locking position by exerting a radial pressure on the sleeve in order to lock the sleeve in position on the mandrel;

a pressure fluid circuit provided between the peripheral wall and the cylindrical core for exerting the radial pressure on the sleeve;

a cooling fluid circuit for allowing a fluid to flow in the region of the cylindrical core and for cooling the mandrel; and a front docking port for the cooling fluid circuit arranged at a front end of the mandrel, and a rear docking port for the pressure fluid circuit arranged at a rear end of the mandrel;

the method comprising the steps of:

connecting only one of the front and rear docking ports of the pressure fluid circuit to the cooling circuit;

exerting a radial pressure on the sleeve with the peripheral wall by sending a fluid through the pressure circuit to lock the sleeve in position on the mandrel; and connecting the front and rear docking ports of the pressure circuit to the cooling circuit and causing a cooled fluid to flow through the pressure circuit in order to cool the mandrel.

14. The method according to claim 13, wherein the flow of the fluid through the pressure circuit in order to cool the mandrel is realized in a closed circuit.

15. The method according to claim 13, wherein the docking port of the pressure circuit connected to the cooling circuit in order to secure the sleeve to the mandrel is the docking port arranged at the rear of the mandrel, on the opposite side from the driver.

* * * * *